US010486923B2

(12) United States Patent
Hashimoto

(10) Patent No.: US 10,486,923 B2
(45) Date of Patent: Nov. 26, 2019

(54) MEDIUM CONVEYING APPARATUS

(71) Applicant: Oki Data Corporation, Tokyo (JP)

(72) Inventor: Hiroki Hashimoto, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 15/955,667

(22) Filed: Apr. 17, 2018

(65) Prior Publication Data

US 2018/0297798 A1 Oct. 18, 2018

(30) Foreign Application Priority Data

Apr. 18, 2017 (JP) ..... 2017-081817

(51) Int. Cl.

| | |
|---|---|
| ***B65H 1/04*** | (2006.01) |
| ***B65H 3/06*** | (2006.01) |
| ***B65H 1/12*** | (2006.01) |
| ***B65H 1/14*** | (2006.01) |

(52) U.S. Cl.

CPC ..... *B65H 3/0669* (2013.01); *B65H 1/04* (2013.01); *B65H 1/12* (2013.01); *B65H 1/14* (2013.01); *B65H 3/0684* (2013.01); *B65H 2404/1424* (2013.01); *B65H 2405/11163* (2013.01); *B65H 2701/1125* (2013.01); *B65H 2701/1916* (2013.01)

(58) Field of Classification Search

CPC ..... B65H 1/04; B65H 3/0669; B65H 3/0684

See application file for complete search history.

(56) References Cited

U.S. PATENT DOCUMENTS

| | | | | |
|---|---|---|---|---|
| 1,490,070 A * | 4/1924 | Korth | A47F 13/085 | 221/34 |
| 2,863,675 A * | 12/1958 | Otto | B42D 5/005 | 211/53 |
| 3,446,500 A * | 5/1969 | Meier | B65H 1/00 | 271/148 |
| 5,511,773 A * | 4/1996 | Burger | B65H 1/12 | 271/148 |
| 6,139,008 A * | 10/2000 | Margiotta | B65H 1/04 | 271/147 |
| 6,142,689 A * | 11/2000 | Margiotta | B65H 1/04 | 400/624 |
| 6,386,534 B1 * | 5/2002 | Woody | B65H 31/10 | 271/213 |

(Continued)

FOREIGN PATENT DOCUMENTS

JP 2000-085997 A 3/2000

*Primary Examiner* — Thomas A Morrison
(74) *Attorney, Agent, or Firm* — Rabin & Berdo, P.C.

(57) ABSTRACT

A medium conveying apparatus for conveying media in a conveying direction includes: a medium container on which the media are stacked; and a medium separator that abuts an uppermost medium of the media stacked on the medium container and separates the uppermost medium from the media stacked on the medium container. The medium container includes: a medium support that abuts a lowermost medium of the media stacked on the medium container and supports the stacked media; and a tilting mechanism that tilts the medium support relative to a horizontal plane at a tilt angle according to a weight of the media stacked on the medium container.

2 Claims, 10 Drawing Sheets

(56) References Cited

U.S. PATENT DOCUMENTS

| | | | | |
|---|---|---|---|---|
| 8,177,223 | B2 * | 5/2012 | Bauer | B65H 1/14 271/145 |
| 8,348,259 | B2 * | 1/2013 | Marasco | B65H 1/14 271/148 |
| 8,827,262 | B2 * | 9/2014 | Itabashi | B65H 1/266 271/148 |
| 9,193,544 | B2 * | 11/2015 | Nakagawa | B65H 1/266 |
| 9,272,857 | B2 * | 3/2016 | Nakagawa | B65H 1/12 |
| 9,434,561 | B2 * | 9/2016 | Nakagawa | B65H 1/266 |
| 2015/0042037 | A1 * | 2/2015 | Nakagawa | B65H 1/266 271/264 |
| 2015/0353303 | A1 * | 12/2015 | Nakagawa | B65H 1/266 271/2 |

* cited by examiner

MEDIUM CONVEYING APPARATUS

BACKGROUND OF THE INVENTION

1. Field of the Invention

The present invention relates to a medium conveying apparatus for sequentially conveying media stacked on a medium container.

2. Description of the Related Art

Conventionally, there is an apparatus including a pickup roller that abuts the uppermost medium of stacked media and applies frictional force to the uppermost medium to convey the uppermost medium in a conveying direction. Japanese Patent Application Publication No. 2000-85997 discloses an image forming apparatus including a paper feed roller that sequentially feeds stacked sheets of paper from the uppermost sheet.

However, in the conventional apparatus, when a large number of media are stacked and the thickness of each of the media is not uniform in a width direction of the medium perpendicular to the conveying direction (e.g., when western envelopes with their flaps folded are conveyed in a direction parallel to a longitudinal direction of the envelopes), the uppermost medium tilts relative to a horizontal plane in a lateral direction that is parallel to the horizontal plane and perpendicular to the conveying direction, and thus abuts only one side of the pickup roller.

When the pickup roller conveys a medium while the medium abuts only one side of the pickup roller, the frictional force applied by the pickup roller to the medium is not uniform in the lateral direction. This causes skew of the medium and reduces accuracy in conveyance of the medium.

SUMMARY OF THE INVENTION

An object of an aspect of the present invention is to provide a medium conveying apparatus capable of accurately conveying media.

According to an aspect of the present invention, there is provided a medium conveying apparatus for conveying media in a conveying direction. The medium conveying apparatus includes: a medium container on which the media are stacked; and a medium separator that abuts an uppermost medium of the media stacked on the medium container and separates the uppermost medium from the media stacked on the medium container. The medium container includes: a medium support that abuts a lowermost medium of the media stacked on the medium container and supports the stacked media; and a tilting mechanism that tilts the medium support relative to a horizontal plane at a tilt angle according to a weight of the media stacked on the medium container.

DETAILED DESCRIPTION OF THE INVENTION

Figure 10:
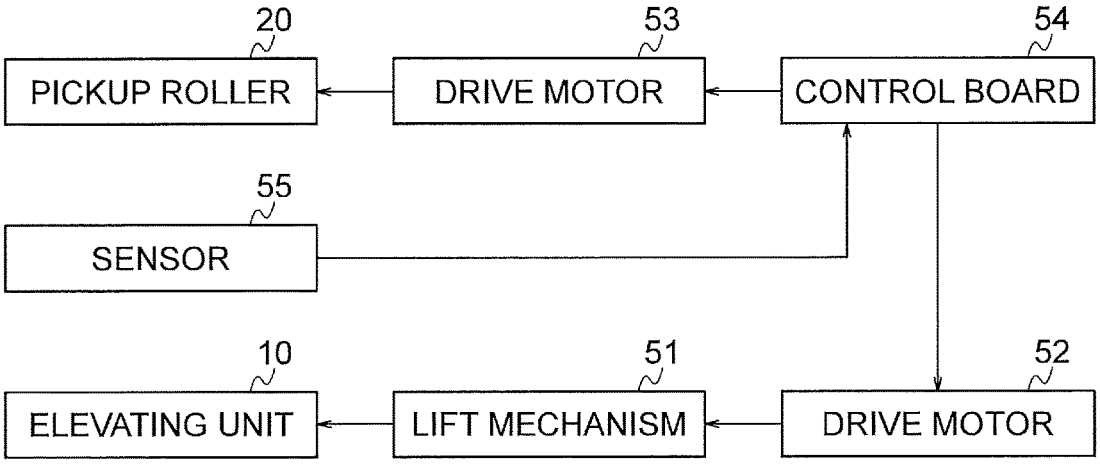
FIG. 10 is a block diagram illustrating the configuration of the medium conveying apparatus according to the first embodiment.

Hereinafter, medium conveying apparatuses according to embodiments of the present invention will be described with reference to the attached drawings. An xyz orthogonal coordinate system is illustrated in the drawings except FIG. 10 to facilitate understanding of the relationship between the drawings. In each of the drawings, the x-axis is a coordinate axis parallel to a transverse direction of a medium conveying apparatus; the y-axis is a coordinate axis parallel to a longitudinal direction of the medium conveying apparatus; the z-axis is a coordinate axis perpendicular to both the x-axis and y-axis, and parallel to an up-down direction of the medium conveying apparatus. In each of the drawings, the y-axis extends in a direction (referred to below as the conveying direction) in which a medium is conveyed by the medium conveying apparatus. The positive y-axis side is the upstream side in the conveying direction, and the negative y-axis side is the downstream side in the conveying direction. The x-axis is parallel to a direction (referred to below as the lateral direction) that is parallel to a horizontal plane and perpendicular to the conveying direction.

<1> First Embodiment

<1-1> Configuration

Figure 1B:
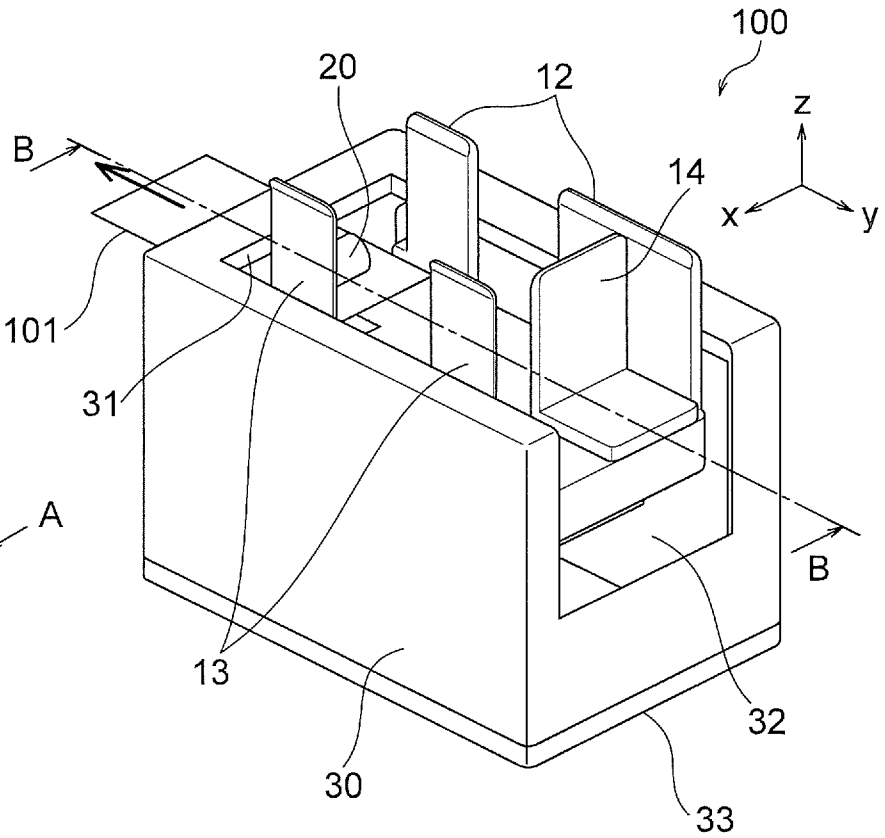
FIGS. 1A and 1B are perspective views schematically illustrating a configuration of a medium conveying apparatus according to a first embodiment of the present invention.
Figure 1A:
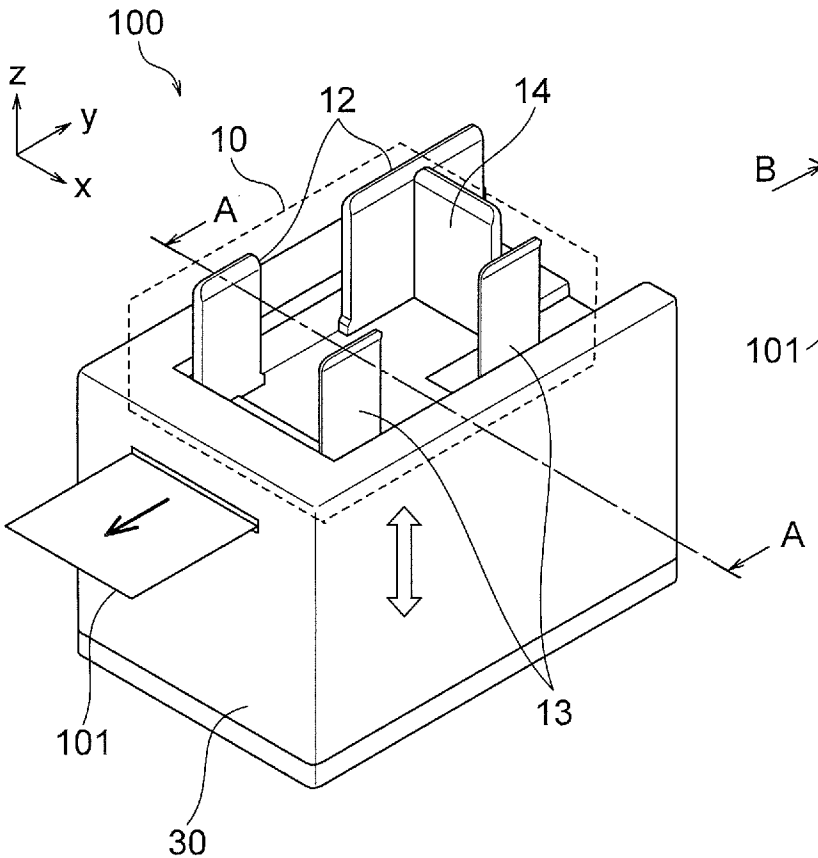

FIGS. 1A and 1B are perspective views schematically illustrating a configuration of a medium conveying apparatus 100 according to a first embodiment of the present invention. FIG. 1A is a view of the medium conveying apparatus 100 as viewed from a point of view on the downstream side in the conveying direction. FIG. 1B is a view of the medium conveying apparatus 100 as viewed from a point of view on the upstream side in the conveying direction. FIGS. 1A and 1B illustrate a state in which an elevating unit 10 (to be described later) of the medium conveying apparatus 100 is at its highest position.

As illustrated in FIGS. 1A and 1B, the medium conveying apparatus 100 according to the first embodiment includes the elevating unit 10 as a medium container, a pickup roller 20 as a medium separator, a cover 30, a front frame 31, a pair of side frames 32, and a base frame 33. The medium conveying apparatus 100 conveys media (e.g., western envelopes) 101 stacked or loaded thereon from the upstream side to the downstream side in the conveying direction.

The elevating unit 10 is a medium container on which media 101 to be conveyed are stacked or loaded. The elevating unit 10 can rise and fall (or move up and down) in the positive and negative z-axis directions according to the number of media 101 stacked on the elevating unit 10. The medium conveying apparatus 100 includes a lift mechanism (or driver) 51 (see FIG. 10) that moves up and down the elevating unit 10, and a drive motor 52 (see FIG. 10) that drives the lift mechanism 51 to move up and down the elevating unit 10.

The elevating unit 10 moves up and down according to the number of media 101 stacked thereon so that the pickup roller 20 constantly abuts the uppermost medium 101 of the stacked media 101. Specifically, the elevating unit 10 moves down in the negative z-axis direction as the number of media 101 stacked on the elevating unit 10 increases, and moves up in the positive z-axis direction as the number of media 101 stacked on the elevating unit 10 decreases.

The pickup roller 20 abuts the uppermost medium 101 of the media 101 stacked on the elevating unit 10, and applies conveying force in the conveying direction to the uppermost medium 101 to separate the uppermost medium 101 from the stacked media 101. That is, the pickup roller 20 picks up the uppermost medium 101 from the stacked media 101 and conveys it in the conveying direction. The pickup roller 20 is rotatably mounted to the side frames 32 through a bracket. The pickup roller 20 may be mounted to the front frame 31. The pickup roller 20 may be urged downward by a spring (not illustrated) to press the uppermost medium 101.

The pickup roller 20 is connected to a drive motor 53 (see FIG. 10) that drives the pickup roller 20 to rotate. The drive motor 53 rotates and stops the pickup roller 20 in accordance with control signals from a control board (or controller) 54 (see FIG. 10). The pickup roller 20 is rotationally driven and stopped by receiving drive force from the drive motor 53.

The pickup roller 20 is configured so that it can move up and down together with the bracket mounted to the side frames 32. The pickup roller 20 moves up and down following the change in the position of the uppermost medium 101 in the up-down direction in FIGS. 1A and 1B. The position of the pickup roller 20 is detected by a sensor 55 (see FIG. 10) mounted to the side frames 32 or front frame 31.

The front frame 31 is a frame provided on the downstream side (or negative y-axis side) of the medium conveying apparatus 100 in the conveying direction. A pair of conveying rollers 40 (see FIG. 5A) is provided in the front frame 31. The pair of conveying rollers 40 is located downstream of the pickup roller 20 in the conveying direction. The pair of conveying rollers 40 serves as a conveyor that applies conveying force in the conveying direction to the medium 101 separated by the pickup roller 20.

The side frames 32 are frames provided on both sides (positive and negative x-axis sides) of the medium conveying apparatus 100. The base frame 33 is a frame provided on the lower side (negative z-axis side) of the medium conveying apparatus 100. The cover 30 is provided outside the front frame 31 and side frames 32, and is a housing that covers the entire medium conveying apparatus 100.

When media 101 are stacked on the elevating unit 10, the elevating unit 10 is positioned at a lower position where the pickup roller 20 presses the uppermost medium 101 at an appropriate pressure, on the basis of detection of the position of the pickup roller 20 by the sensor 55. As the media 101 are sequentially conveyed from the uppermost medium, the position of the pickup roller 20 lowers. When the position of the pickup roller 20 has lowered below a predetermined level, the elevating unit 10 is moved up to a position where the pickup roller 20 presses the uppermost medium 101 at an appropriate pressure, and then is stopped. This operation is repeated as necessary. Specifically, the control board 54 controls the drive motor 52 to move up and down the elevating unit 10 on the basis of the position of the pickup roller 20 detected by the sensor 55.

The pickup roller 20 separates and conveys the uppermost medium 101, and the pair of conveying rollers 40 further conveys the separated uppermost medium 101. In some cases, the pickup roller 20 separates a few media 101 including the uppermost medium 101 from the stacked media 101 and conveys them, and the pair of conveying rollers 40 finally separates the uppermost medium 101 from the media 101 separated by the pickup roller 20 and conveys it.

Figure 2C:
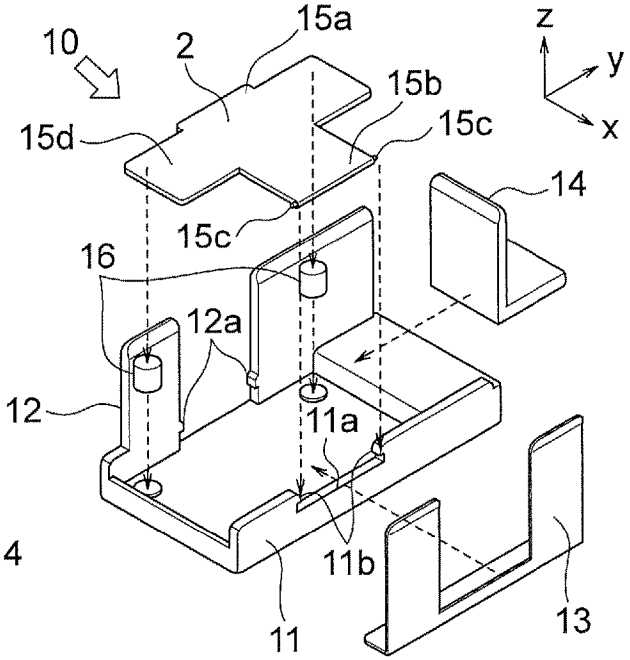
FIGS. 2A to 2C are perspective views schematically illustrating a configuration of an elevating unit of the first embodiment.
Figure 2B:
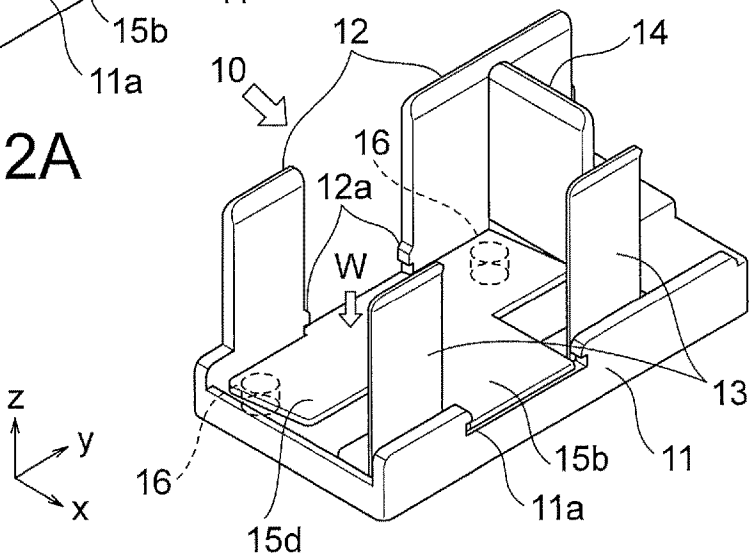
Figure 2A:
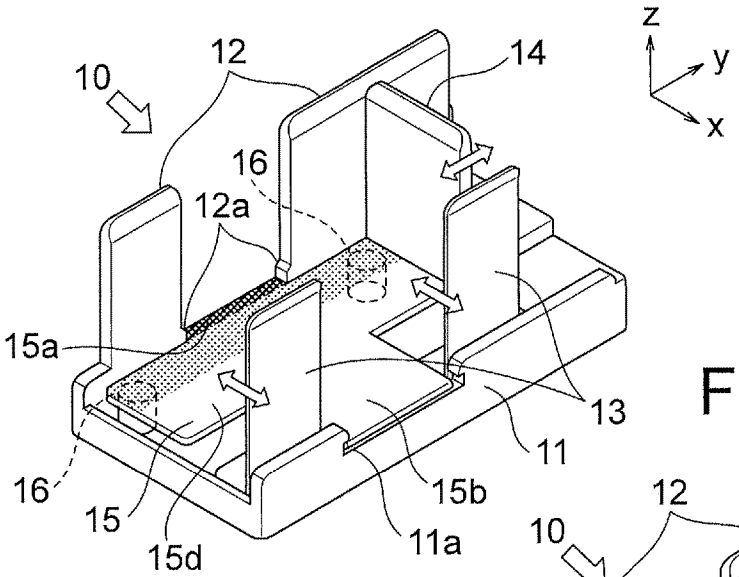

FIGS. 2A to 2C are perspective views schematically illustrating a configuration of the elevating unit 10 of the first embodiment.

As illustrated in FIG. 2A, the elevating unit 10 includes an elevating base 11, a fixed guide 12, a movable guide 13, a rear guide 14, a lift plate 15 as a medium support, and springs 16 as a tilting mechanism.

FIGS. 2A to 2C are views of the elevating unit 10 of the first embodiment as viewed from the movable guide 13 side. FIG. 2A illustrates a state in which the lift plate 15 is horizontal. FIG. 2B illustrates a state in which the lift plate 15 is rotated and tilted.

The elevating base 11 forms a bottom of the elevating unit 10 and is a base of the elevating unit 10.

As illustrated in FIGS. 2A to 2C, the elevating base 11 includes a side portion on the positive x-axis side, which includes a supporting portion (or holding portion) 11*a* for rotatably supporting (or holding) the lift plate 15. The supporting portion 11*a* includes, on both sides, two holes (or bearings) 11*b* that engage with or receive projections (or support shafts) 15*c* (to be described later) of the lift plate 15.

As illustrated in FIG. 2A, the fixed guide 12 is provided on the negative x-axis side of the elevating base 11. The fixed guide 12 abuts a side surface on the negative x-axis side of the media 101 stacked on the elevating unit 10 and limits movement of the stacked media 101 in the negative x-axis direction. The fixed guide 12 is fixed to the elevating base 11. In the middle of the fixed guide 12, there are provided limiters 12*a* as a movement limiter that limits rotational movement of the lift plate 15 in the upward direction.

As illustrated in FIG. 2A, the limiters 12*a* are disposed at two positions. Each of the limiters 12*a* is a part of the fixed guide 12 that projects inward. The limiters 12*a* abut a fixed guide side projection 15*a* (to be described later) of the lift plate 15 to limit rotational movement of the lift plate 15 in the positive z-axis direction.

As illustrated in FIG. 2A, the movable guide 13 is provided on the positive x-axis side of the elevating base 11. The movable guide 13 abuts a side surface on the positive x-axis side of the media 101 stacked on the elevating unit 10 to limit movement of the stacked media 101 in the positive x-axis direction. As illustrated in FIG. 2A, the movable guide 13 is movable in the positive and negative x-axis directions in accordance with the size of the stacked media 101. The movable guide 13 is set at a position where the media 101 are sandwiched between the fixed guide 12 and the movable guide 13, and then is locked by a lock mechanism (not illustrated) to maintain the stacked state.

As illustrated in FIG. 2A, the rear guide 14 is provided on the positive y-axis side of the elevating base 11. The rear guide 14 abuts a side surface (or rear surface) on the positive y-axis side of the media 101 stacked on the elevating unit 10 to limit movement of the stacked media 101 in the positive y-axis direction. As illustrated in FIG. 2A, the rear guide 14 is movable in the positive and negative y-axis directions in accordance with the size of the stacked media 101. The rear guide 14 is set at a position where the media 101 are sandwiched between the front frame 31 and the rear guide 14, and then is locked by a lock mechanism (not illustrated) to maintain the stacked state.

As illustrated in FIG. 2A, the lift plate 15 is provided on the positive z-axis side of (or above) the elevating base 11. The lift plate 15 abuts the lowermost medium 101 of the media 101 stacked on the elevating unit 10. As illustrated in FIG. 2A, the lift plate 15 includes a base portion 15*d* that abuts the lowermost medium 101, a movable guide side projection 15*b* as a first projection that projects from the base portion 15*d* toward one end of the lift plate 15 on the movable guide 13 side in the lateral direction (or x-axis direction), and the fixed guide side projection 15*a* as a second projection that projects from the base portion 15*d* toward the other end of the lift plate 15 on the fixed guide 12 side in the lateral direction.

As illustrated in FIG. 2C, two projections 15*c* are provided at an end portion on the positive x-axis side of the movable guide side projection 15*b* of the lift plate 15. The projections 15*c* of the lift plate 15 are fitted into the holes 11*b* of the elevating base 11 so that the lift plate 15 is rotatably supported by the elevating base 11. The lift plate 15 can rotate or pivot about the supporting portion 11*a* (specifically, the holes 11*b*) in the positive and negative z-axis directions. The lift plate 15 can rotate and tilt about a rotational axis parallel to the conveying direction (or y-axis) with the movable guide side projection 15*b* supported by the supporting portion 11*a*.

As illustrated in FIG. 2A, the two springs 16 are provided under the fixed guide 12 side (or the base portion 15*d*) of the lift plate 15. The springs 16 tilt the lift plate 15 relative to a horizontal plane in the lateral direction at a tilt angle according to the weight of the media 101 stacked on the elevating unit 10. The springs 16 are provided between the elevating base 11 and the lift plate 15, and function as elastic members that apply elastic force in the positive z-axis direction to the lift plate 15. The springs 16 abut a lower side (or back surface) of the lift plate 15 (specifically, base portion 15*d*) and apply upward elastic force to the lift plate 15. The number of springs 16 and the positions of the springs 16 are not limited to those illustrated in FIG. 2A. For example, the number of springs 16 provided in the elevating unit 10 may be one, three, or more.

The lift plate 15 is subjected to gravitational force in the negative z-axis direction due to the weight of the stacked media 101 and the self-weight of the lift plate 15, and rotationally moves (or tilts) about the supporting portion 11*a* of the elevating base 11 in the negative z-axis direction. Also, the lift plate 15 rotationally moves about the supporting portion 11*a* of the elevating base 11 in the positive z-axis direction due to elastic force in the positive z-axis direction applied by the springs 16. FIG. 2B illustrates a state in which the lift plate 15 is tilted downward due to the weight load W of the stacked media 101 (not illustrated in FIG. 2B).

The tilt angle (or amount of rotational movement) of the lift plate 15 changes depending on the weight (or number) of media 101 stacked on the elevating unit 10. Specifically, as the number of media 101 stacked on the elevating unit 10 increases, the amount of rotational movement of the lift plate 15 in the negative z-axis direction increases and the lift plate 15 lowers. As the number of media 101 stacked on the elevating unit 10 decreases, the amount of rotational movement of the lift plate 15 in the negative z-axis direction decreases and the lift plate 15 rises. Thus, the tilt angle of the lift plate 15 increases as the weight of the media 101 stacked on the elevating unit 10 increases.

The fixed guide side projection 15*a* of the lift plate 15 comes into contact with the limiters 12*a* of the fixed guide 12, thereby limiting or preventing rotational movement of the lift plate 15 in the positive z-axis direction. When the number of media 101 stacked on the elevating unit 10 decreases and the elastic force by the springs 16 in the positive z-axis direction exceeds the gravitational force in the negative z-axis direction, the fixed guide side projection 15*a* of the lift plate 15 comes into contact with the limiters 12*a* of the fixed guide 12. When the fixed guide side projection 15*a* is in contact with the limiters 12*a*, the lift plate 15 is in a substantially horizontal attitude (see FIG. 2A).

Figure 3:
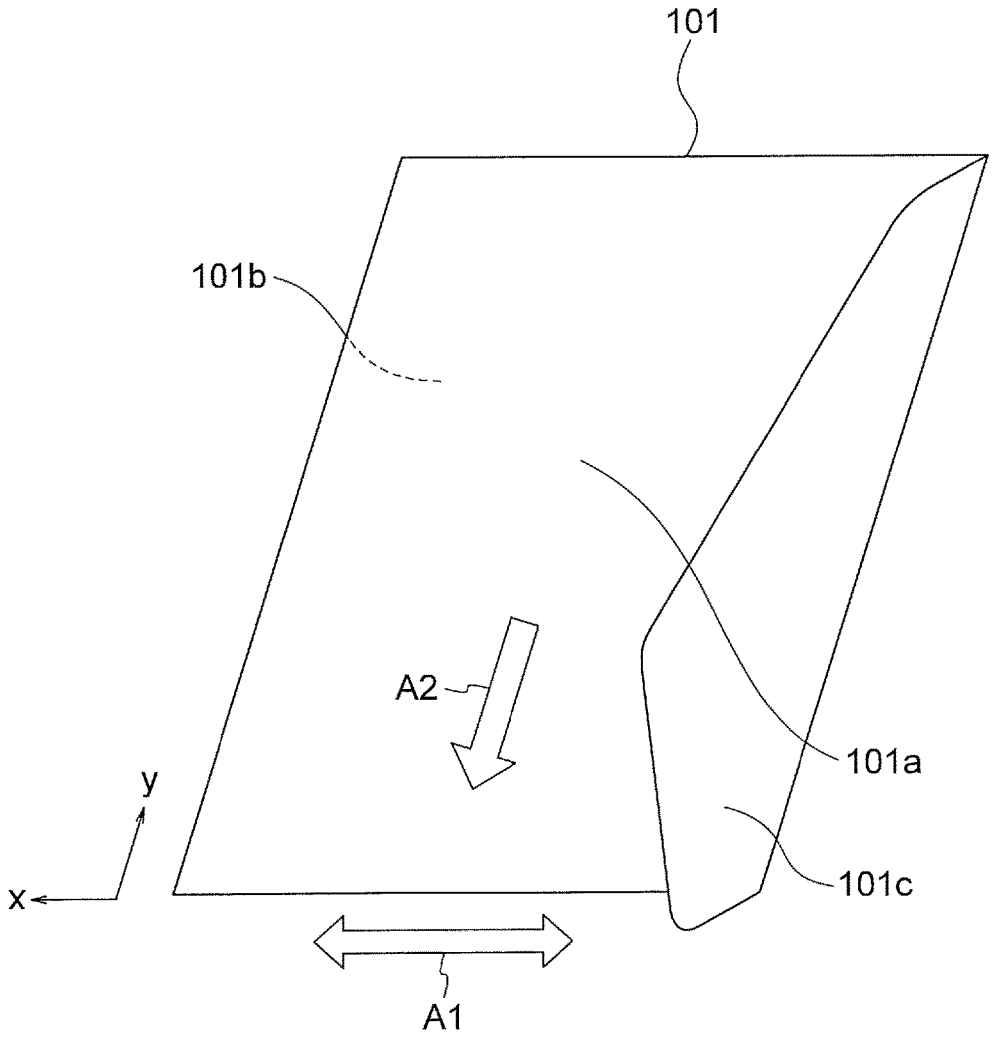
FIG. 3 is a perspective view schematically illustrating a configuration of a medium stacked on the medium conveying apparatus according to the first embodiment.

FIG. 3 is a perspective view schematically illustrating one of the media 101 stacked on the medium conveying apparatus 100 according to the first embodiment. The medium 101 in the first embodiment is, for example, a western or Japanese envelope whose thickness is not uniform in a width direction (indicated by arrow A1 in FIG. 3) of the medium 101. The width direction of the medium 101 may be perpendicular to the conveying direction (indicated by arrow A2) when the medium 101 is stacked on the elevating unit 10. The width direction of the medium 101 may be parallel to the lateral direction when the medium 101 is stacked on the lift plate 15 in a horizontal attitude. The medium 101 stacked on the medium conveying apparatus 100 may be a medium whose thickness is uniform in the width direction of the medium.

As illustrated in FIG. 3, the medium 101 has a lower side 101*a* that faces downward when the medium 101 is stacked on the lift plate 15, and an upper side 101*b* that faces upward when the medium 101 is stacked on the lift plate 15. On the lower side 101*a* of the medium 101, there is provided a flap 101*c* that is a sealing flap for sealing the medium 101. The flap 101*c* is located, for example, on the negative x-axis side of the medium 101.

When media 101 are stacked on the medium conveying apparatus 100, all the media 101 are oriented in the same direction, and thus the media 101 are stacked in such a manner that the flaps 101*c* of the media 101 overlap each other. Thus, the thickness of the flap 101*c* side (or the negative x-axis side) of the stacked media 101 is greater than the thickness of the side opposite to the flap 101*c* (or the positive x-axis side) of the stacked media 101. Also, the weight of the flap 101*c* side (or the negative x-axis side) of the stacked media 101 is greater than the weight of the side opposite to the flap 101*c* (or the positive x-axis side) of the stacked media 101.

<1-2> Operation

The operation of the medium conveying apparatus 100 according to the first embodiment will be described below with reference to FIGS. 4A to 4C and 5A to 5C.

FIGS. 4A to 4C and 5A to 5C are vertical sectional views each schematically illustrating the configuration of the medium conveying apparatus 100 according to the first embodiment.

Figure 4A:
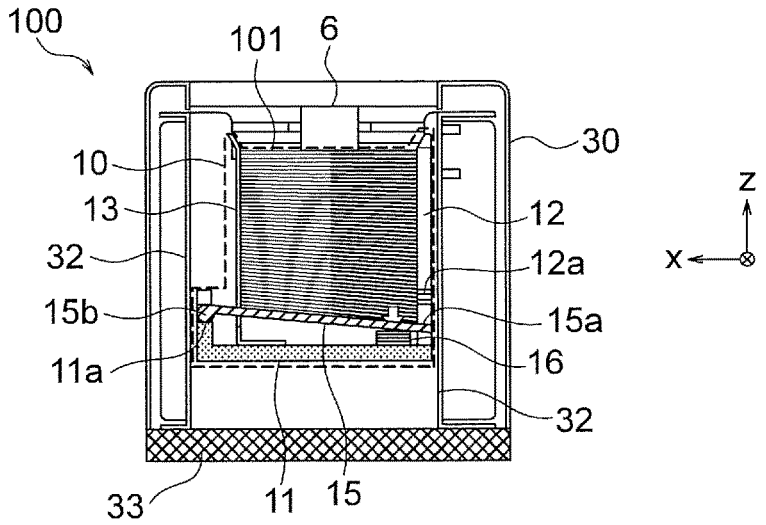
FIGS. 4A to 4C and 5A to 5C are vertical sectional views schematically illustrating the configuration of the medium conveying apparatus according to the first embodiment.
Figure 4B:
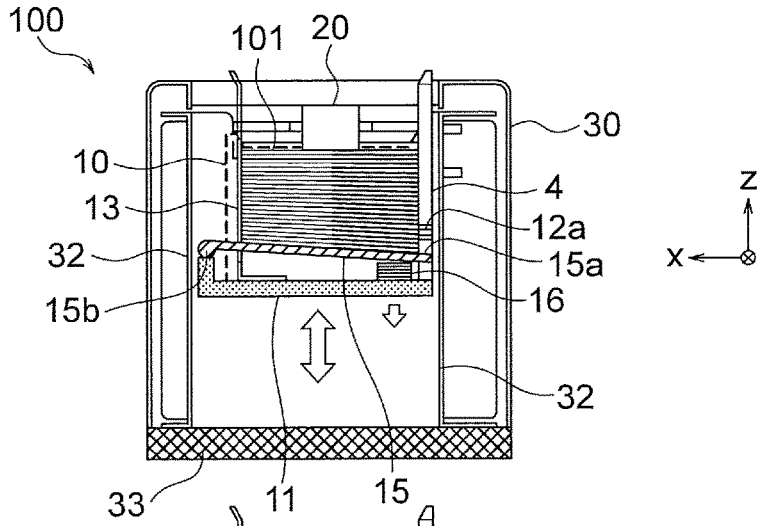
Figure 4C:
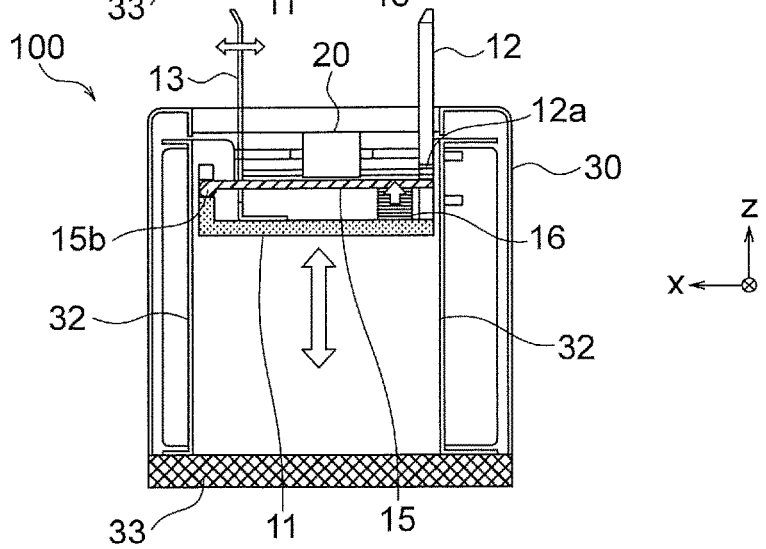

FIGS. 4A to 4C are views of the medium conveying apparatus 100 according to the first embodiment as viewed from the upstream side of the conveying direction. FIGS. 4A to 4C are sectional views taken along line A-A in FIG. 1A.

Figure 5A:
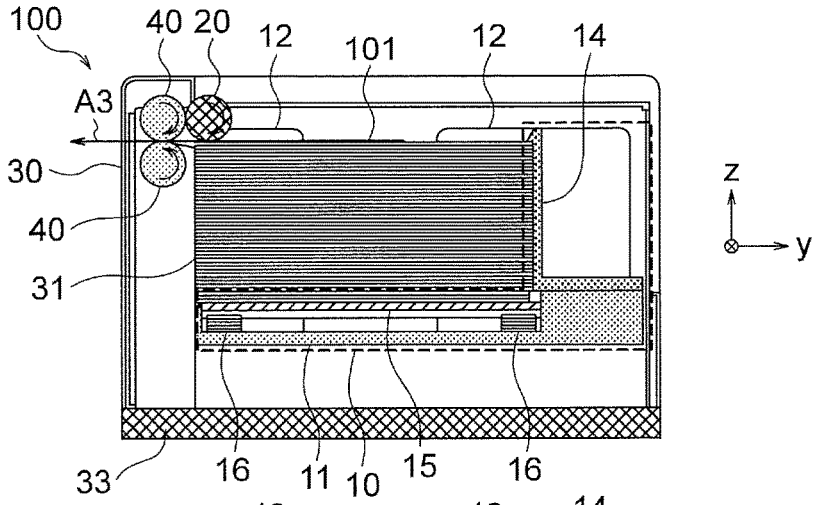
Figure 5B:
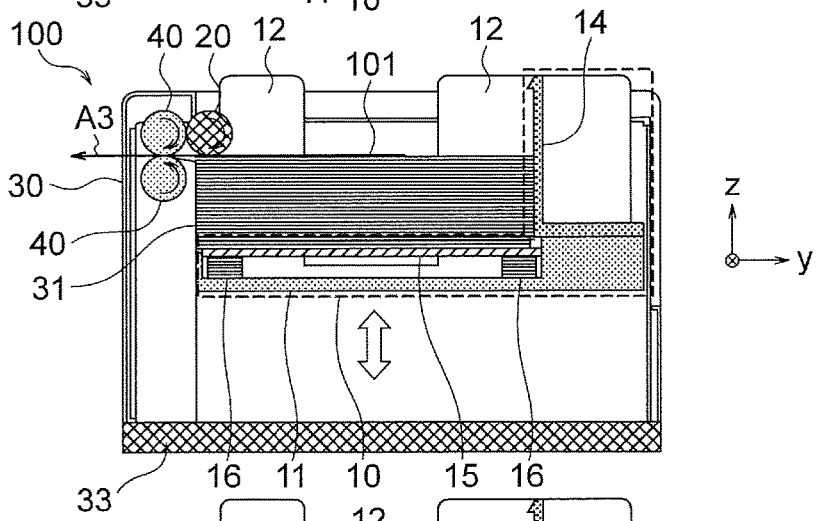
Figure 5C:
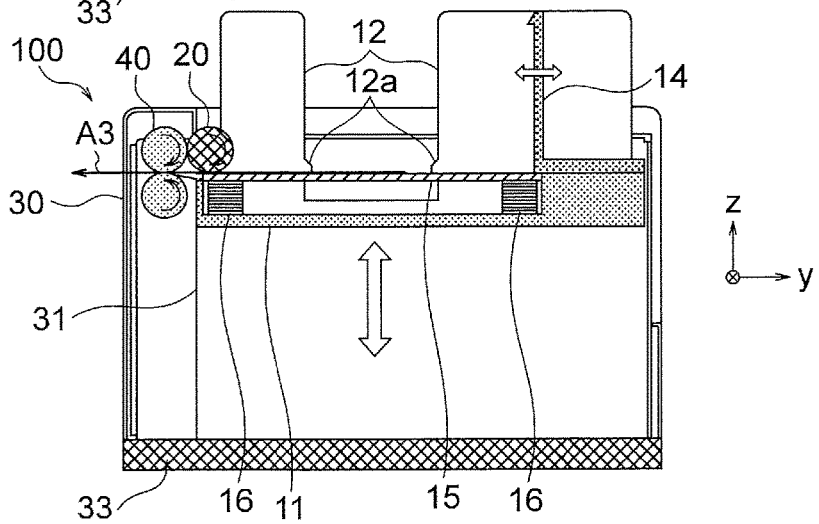

FIGS. 5A to 5C are views of the medium conveying apparatus 100 according to the first embodiment as viewed from the movable guide 13 side. FIGS. 5A to 5C are sectional views taken along line B-B in FIG. 1B. FIGS. 5A to 5C correspond to FIGS. 4A to 4C, respectively. In each of FIGS. 5A to 5C, arrow A3 indicates the conveying direction.

FIGS. 4A and 5A illustrate a state in which the elevating unit 10 is at its lowest position. In FIG. 4A, a large number (e.g., maximum stackable number) of media 101 are stacked on the elevating unit 10.

FIGS. 4B and 5B illustrate a state in which the elevating unit 10 is at an intermediate position between its highest and lowest positions. In FIG. 4B, half the maximum stackable number of media 101 are stacked on the elevating unit 10.

FIGS. 4C and 5C illustrate a state in which the elevating unit 10 is at its highest position. In FIG. 4C, no media 101 are stacked on the elevating unit 10.

As illustrated in FIGS. 4A to 4C and 5A to 5C, the elevating unit 10 of the medium conveying apparatus 100 moves up and down in the upward and downward directions (or positive and negative z-axis directions) in the drawings depending on the number of media 101 stacked on the elevating unit 10. In the example of the drawings, the media 101 are stacked such that their flaps 101*c* are stacked on the negative x-axis side.

As illustrated in FIGS. 4A and 5A, when a large number of media 101 are stacked on the elevating unit 10, the elevating unit 10 is lowered to its lowest position. At this time, as illustrated in FIG. 4A, the flaps 101*c* of the media 101 are stacked on the fixed guide 12 side (or negative x-axis side) of the lift plate 15, and the thickness of the media 101 is greater on the fixed guide 12 side (or negative x-axis side) than on the movable guide 13 side (or positive x-axis side).

Thus, there is a difference in weight of the media 101 in the lateral direction (or x-axis direction), and the weight of the fixed guide 12 side of the media 101 is greater than that of the movable guide 13 side of the media 101. Due to this difference in weight, the lift plate 15, which abuts the lowermost medium 101, is loaded near the fixed guide 12, and is rotated and tilted about the supporting portion 11*a* of the elevating base 11 in the negative z-axis direction. As illustrated in FIG. 4A, due to the tilt of the lift plate 15, the uppermost medium 101 of the stacked media 101 is in a substantially horizontal attitude.

At this time, the springs 16 under the lift plate 15 are compressed to their minimum lengths. The spring constants of the springs 16 are set so that when a large number of media 101 are stacked and the lift plate 15 is tilted due to the weight difference, the uppermost medium 101 is substantially horizontal. For example, when the difference in height from the lowermost medium 101 to the uppermost medium 101 of the stacked media 101 between the left and right sides in the lateral direction is 30 mm, the difference in weight between the left and right sides of the stacked media 101 is 60 g, and the number of springs 16 is two, the spring constant of each of the springs 16 is set to 1 g/mm and the total spring constant of the springs 16 is set to 2 g/mm.

As illustrated in FIGS. 4B and 5B, when half the maximum stackable number of media 101 are stacked on the elevating unit 10, the elevating unit 10 is at the intermediate position between the highest and lowest positions. At this time, as illustrated in FIG. 4B, the number of stacked media 101 is half that in FIG. 4A, and thus the difference in weight of the stacked media 101 in the lateral direction (or x-axis direction) is about half that in FIG. 4A. Thus, the tilt angle of the lift plate 15 is also about half that in FIG. 4A. At this time, the springs 16 under the lift plate 15 are extended as compared to those in FIG. 4A. As illustrated in FIG. 4B, even when the number of media 101 stacked on the elevating unit 10 is half the maximum stackable number, the uppermost medium 101 is in a substantially horizontal attitude due to the decrease in the tilt angle of the lift plate 15.

As illustrated in FIGS. 4C and 5C, when no media 101 are stacked on the elevating unit 10, the elevating unit 10 is at its highest position. At this time, as illustrated in FIG. 4C, the weight applied to the springs 16 is only the weight of the lift plate 15. Thus, the springs 16 under the lift plate 15 are extended to their maximum lengths, and the fixed guide side projection 15*a* of the lift plate 15 abuts the limiters 12*a* of the fixed guide 12, thereby preventing or limiting rotational movement of the lift plate 15 in the upward direction. Thus, the lift plate 15 is in a substantially horizontal attitude and the tilt angle thereof is substantially zero.

<1-3> Advantages

As above, in the medium conveying apparatus 100 according to the first embodiment, when media 101 whose thicknesses are not uniform in the width direction are stacked, the lift plate 15, which abuts the lowermost medium 101, tilts according to the weight of the stacked media 101. This makes it possible to maintain the uppermost medium 101, which abuts the pickup roller 20, in a substantially horizontal attitude regardless of the weight of the stacked media 101. Thus, one-sided abutment (to be described later) of the pickup roller 20 against the uppermost medium 101 is diminished or prevented, and a gap (to be described later) between the stacked media 101 and a guide (the fixed guide 12 or movable guide 13) for sandwiching the media 101 is reduced. Thereby, it is possible to prevent occurrence of skew of the media 101 and improve accuracy in conveyance of the media 101.

With this embodiment, it is possible to reduce the tilt of the uppermost medium 101 in the lateral direction and prevent one-sided abutment of the pickup roller 20 against the uppermost medium 101, thereby improving accuracy in conveyance of the media 101.

In the medium conveying apparatus 100 according to the first embodiment, the lift plate 15 includes the fixed guide side projection 15*a* and the fixed guide 12 includes the limiters 12*a*. As the number of remaining stacked media 101 gradually decreases after conveyance of the media 101 starts, the tilt angle of the lift plate 15 gradually approaches horizontal, and the fixed guide side projection 15*a* of the lift plate 15 comes into contact with the limiters 12*a* of the fixed guide 12, thereby preventing the lift plate 15 from further moving upward. This prevents a situation in which when the number of remaining stacked media 101 decreases, the lift plate 15 is pushed up by the springs 16 to a position higher than a position where the lift plate 15 is horizontal, and tilts the uppermost medium 101.

<2> Second Embodiment

<2-1> Configuration

Figure 6B:
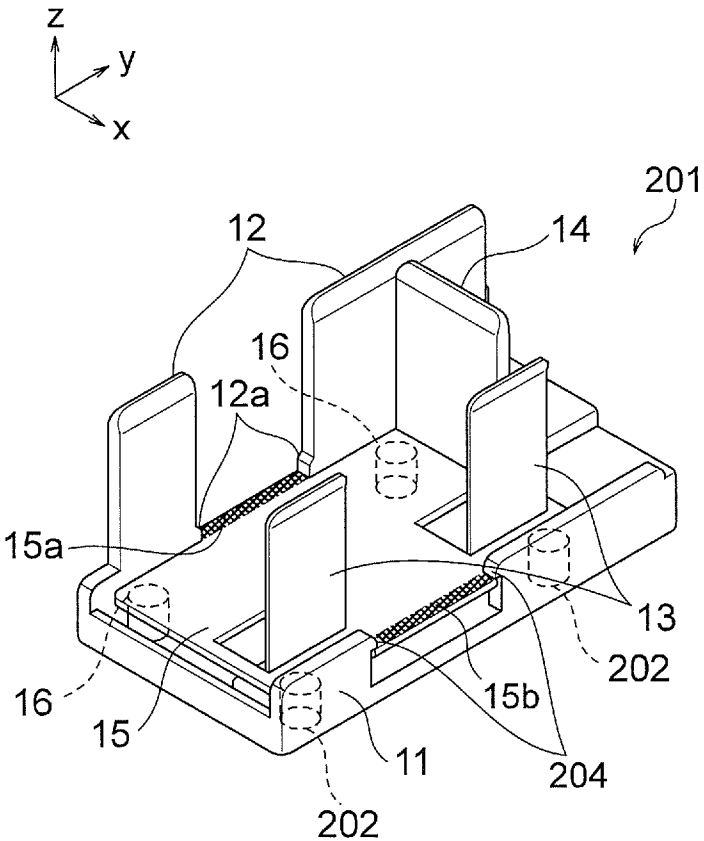
FIG. 6B is a perspective view schematically illustrating a configuration of an elevating unit of the second embodiment.
Figure 6A:
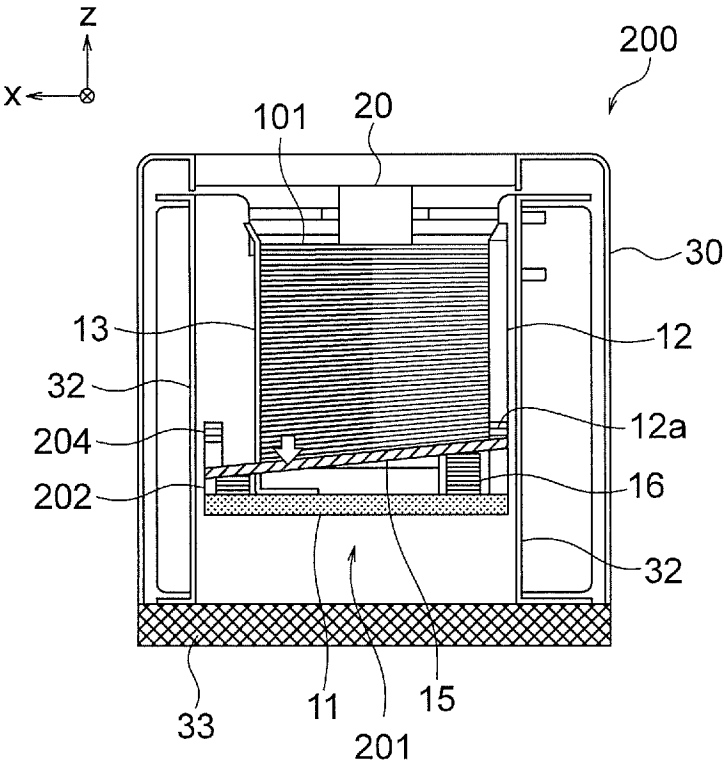
FIG. 6A is a vertical sectional view schematically illustrating a configuration of a medium conveying apparatus according to a second embodiment.

FIG. 6A is a vertical sectional view schematically illustrating a configuration of a medium conveying apparatus 200 according to a second embodiment. The medium conveying apparatus 200 of the second embodiment is similar in many aspects to the medium conveying apparatus 100 of the first embodiment. Parts that are the same as or correspond to those of the first embodiment will be given the same reference characters, and descriptions thereof will be omitted. FIG. 6A is a view of the medium conveying apparatus 200 according to the second embodiment as viewed from the upstream side in the conveying direction. The medium conveying apparatus 200 includes an elevating unit 201 instead of the elevating unit 10. FIG. 6A illustrates a state in which the elevating unit 201 is at its lowest position. In FIG. 6A, a large number (e.g., maximum stackable number) of media 101 are stacked on the elevating unit 201.

FIG. 6B is a perspective view schematically illustrating a configuration of the elevating unit 201 of the second embodiment. FIG. 6B is a view of the elevating unit 201 of the second embodiment as viewed from the movable guide 13 side. FIG. 6B illustrates a state in which the lift plate 15 of the elevating unit 201 of the second embodiment is in a horizontal attitude.

As illustrated in FIGS. 6A and 6B, the elevating unit 201 of the medium conveying apparatus 200 according to the second embodiment differs from the elevating unit 10 of the medium conveying apparatus 100 according to the first embodiment in that two springs 202 are provided under the movable guide 13 side of the lift plate 15. Further, the elevating unit 201 of the second embodiment differs from the elevating unit 10 of the first embodiment in that the elevating base 11 of the second embodiment does not have the supporting portion 11*a* as described in the first embodiment.

As illustrated in FIG. 6B, the two springs 202 as first elastic members are provided under the movable guide 13 side of the lift plate 15 of the elevating unit 201 of the medium conveying apparatus 200 according to the second embodiment. Further, as in the medium conveying apparatus 100 according to the first embodiment, two springs 16 as second elastic members are provided under the fixed guide 12 side of the lift plate 15 of the elevating unit 201. Thus, the lift plate 15 is supported by the four springs 16 and 202.

As illustrated in FIG. 6B, the elevating base 11 of the elevating unit 201 of the second embodiment includes limiters 204 that limit movement of the movable guide side projection 15*b* of the lift plate 15 in the upward direction. Thus, the elevating base 11 of the elevating unit 201 of the second embodiment is configured so that the limiters 12*a* limit upward movement of the fixed guide side projection 15*a* and the limiters 204 limit upward movement of the movable guide side projection 15*b*.

When no media 101 are stacked on the elevating unit 201, the four springs 16 and 202 apply upward elastic force to the lift plate 15 (or urge the lift plate 15 upward) and press the fixed guide side projection 15*a* against the limiters 12*a* and the movable guide side projection 15*b* against the limiters 204, so that the lift plate 15 is in a horizontal attitude.

As illustrated in FIG. 6A, when a large number of media 101 are stacked on the elevating unit 201, the lift plate 15 is tilted due to a difference in weight of the stacked media 101 in the lateral direction. In FIG. 6A, the media 101 are stacked such that the flaps 101*c* of the media 101 are stacked on the positive x-axis side of the lift plate 15. Thus, there is a difference in weight of the stacked media 101 in the lateral direction (or x-axis direction), and the weight of the positive x-axis side of the media 101 is greater than the weight of the negative x-axis side of the media 101. Thus, the lift plate 15 is subjected to a greater gravitational force on the positive x-axis side, moved downward, and tilted in the lateral direction. The lift plate 15 is tilted relative to a horizontal plane due to the difference in compression rate between the springs 202 and the springs 16 caused by the difference in weight of the media 101 stacked on the elevating unit 10 in the lateral direction. Due to the tilt of the lift plate 15, the uppermost medium 101 of the media 101 stacked on the lift plate 15 is in a horizontal attitude.

In this manner, when the media 101 are stacked on the elevating unit 201, the springs 202 on the side on which the weight of the media 101 is heavier are compressed more than the springs 16 on the side on which the weight of the media 101 is lighter. This maintains the uppermost medium 101 in a horizontal attitude.

Further, as the number of remaining stacked media 101 gradually decreases after conveyance of the media 101 starts, the difference in weight of the media 101 in the lateral direction gradually decreases, and the tilt angle of the lift plate 15 gradually approaches horizontal. Thus, it is possible to prevent the uppermost medium 101 from tilting greatly and maintain the uppermost medium 101 in a horizontal attitude.

Further, the lift plate 15 is supported by the four springs 16 and 202. Thus, the tilt direction of the lift plate 15 is not limited to the lateral direction (or x-axis direction), and the lift plate 15 can tilt in other directions. For example, when the flaps 101*c* are stacked on the upstream side in the conveying direction, the springs on the upstream side in the conveying direction are compressed more than the springs on the downstream side in the conveying direction, so that the lift plate 15 tilts in the conveying direction.

As above, in the medium conveying apparatus 200 according to the second embodiment, the lift plate 15 of the elevating unit 201 are supported by the four springs 16 and 202, and the lift plate 15 tilts in the lateral direction due to the difference in weight of the stacked media 101 in the lateral direction. Thus, it is possible to maintain the uppermost medium 101, on which the pickup roller 20 abuts, in a horizontal attitude regardless of the remaining number of media 101 stacked on the elevating unit 201. Thus, one-sided abutment (to be described later) of the pickup roller 20 against the uppermost medium 101 is diminished or prevented, and a gap (to be described later) between the stacked media 101 and a guide (the fixed guide 12 or movable guide 13) for sandwiching the media 101 is reduced. Thereby, it is possible to prevent occurrence of skew of the media 101 and improve accuracy in conveyance of the media 101.

Further, the medium conveying apparatus 200 according to the second embodiment includes the four springs. Thus, the tilt direction of the lift plate 15 is not limited to the lateral direction, and the lift plate 15 can tilt in other directions (e.g., the conveying direction). Thus, even when there is a difference in weight of the media 101 in a direction (e.g., the conveying direction) other than the lateral direction, it is possible to maintain the uppermost medium 101 in a horizontal attitude.

<3> Comparative Example

Figure 7:
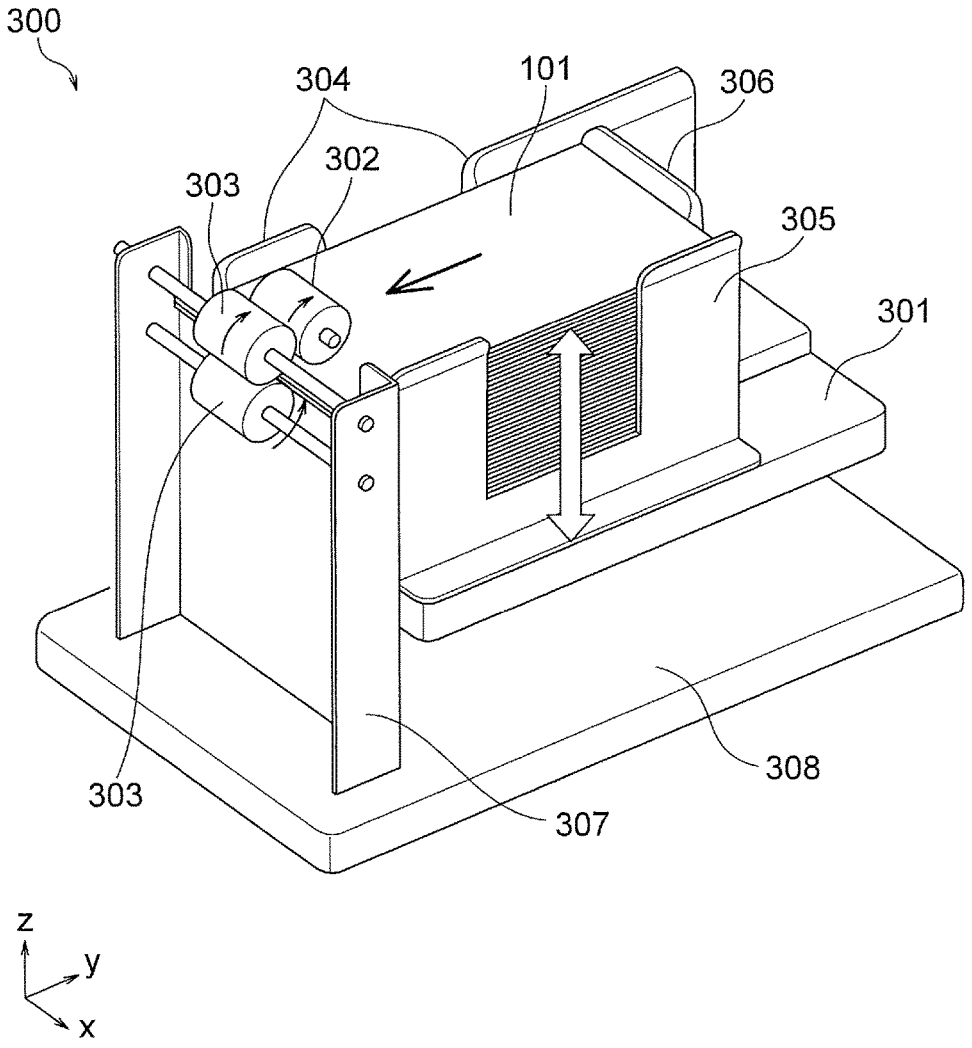
FIG. 7 is a perspective view schematically illustrating a configuration of a medium conveying apparatus according to a comparative example.

FIG. 7 is a perspective view schematically illustrating a configuration of a medium conveying apparatus 300 according to a comparative example. The medium conveying apparatus 300 according to the comparative example differs from the medium conveying apparatus 100 according to the first embodiment in having no lift plate that can tilt according to the weight of stacked media.

As illustrated in FIG. 7, the medium conveying apparatus 300 according to the comparative example includes an elevating base 301 on which media 101 are stacked, a pickup roller 302 for picking up the uppermost medium 101 of the stacked media 101, and a pair of conveying rollers 303 disposed downstream of the pickup roller 302, and a base frame 308. The medium conveying apparatus 300 also includes a fixed guide 304, a movable guide 305, a rear guide 306, and a front frame 307 for tightly surrounding four sides of the media 101 stacked on the elevating base 301 to maintain the attitude of the stacked media 101.

The pickup roller 302 separates and conveys the uppermost medium 101 of the stacked media 101, and the pair of conveying rollers 303 further conveys the separated uppermost medium 101. In some cases, the pickup roller 302 separates a few media 101 including the uppermost medium 101 from the stacked media 101 and conveys them, and the pair of conveying rollers 303 finally separates the uppermost medium 101 from the media 101 separated by the pickup roller 302 and conveys it.

Although not illustrated, the medium conveying apparatus 300 according to the comparative example further includes a lift mechanism that moves up and down the elevating base 301, a drive motor that drives the lift mechanism, a bracket for mounting the pickup roller 302, a spring for pressing the pickup roller 302 against the stacked media 101, a roller drive motor for driving the pickup roller 302 to rotate, and a sensor for detecting the position of the pickup roller 302 to detect the position of the uppermost medium 101.

The pickup roller 302 abuts the uppermost medium 101 while being urged in a downward direction in FIG. 7 by the spring through the bracket. The pickup roller 302 is rotatably fixed to the bracket. The roller drive motor rotationally drives and stops the pickup roller 302 in accordance with signals from a control board (not illustrated).

The pickup roller 302 is mounted so that it can move up and down together with the bracket, which is mounted to the front frame 307. The pickup roller 302 moves up and down following the change in the position of the uppermost medium 101, which abuts the pickup roller 302, in an up-down direction in FIG. 7. The sensor, which is mounted to the front frame 307 and close to the pickup roller 302, detects the position of the pickup roller 302 in the up-down direction, thereby detecting the position of the uppermost medium 101, which constantly abuts the pickup roller 302.

The elevating base 301, fixed guide 304, movable guide 305, and rear guide 306 constitute an elevating unit, which can move up and down together with the media 101 and is driven by the drive motor. The fixed guide 304, movable guide 305, and rear guide 306 surround both sides and the rear end of the media 101.

When media 101 are stacked on the elevating unit, the elevating unit is positioned at a lower position where the pickup roller 302 presses the uppermost medium 101 at an appropriate pressure, on the basis of detection of the position of the pickup roller 302 by the sensor. As the media 101 are sequentially conveyed from the uppermost medium, the position of the pickup roller 302 lowers. When the position of the pickup roller 302 has lowered below a predetermined level, the elevating base 301 is moved up to a position where the pickup roller 302 presses the uppermost medium 101 at an appropriate pressure, and then is stopped. This operation is repeated as necessary. This can stabilize the pickup force regardless of the number of remaining stacked media 101.

Figure 8:
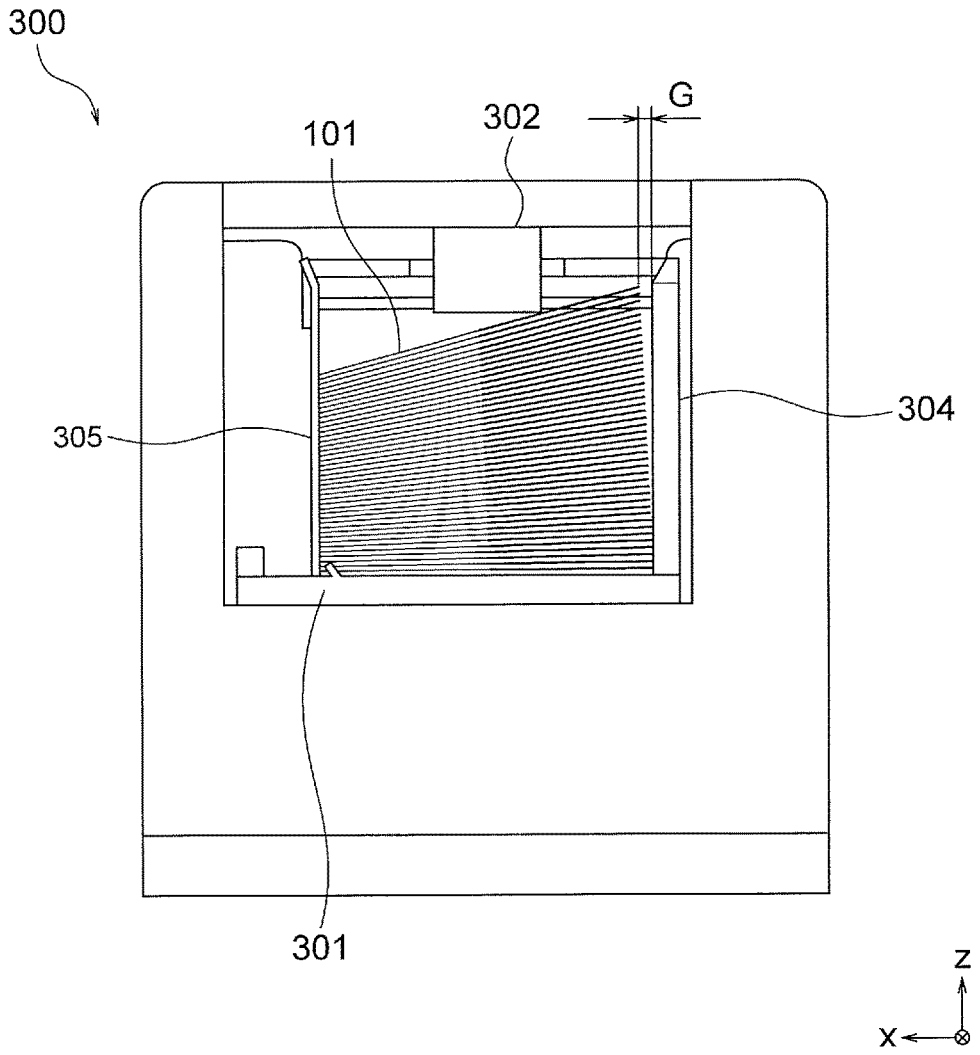
FIG. 8 is a vertical sectional view schematically illustrating the configuration of the medium conveying apparatus according to the comparative example.

FIG. 8 is a vertical sectional view schematically illustrating the configuration of the medium conveying apparatus 300 according to the comparative example. In the medium conveying apparatus 300 according to the comparative example, when a large number of media 101 are stacked and the thickness of each of the media 101 is not uniform in a width direction of the medium perpendicular to the conveying direction (e.g., when western envelopes with their flaps folded are conveyed in a direction parallel to a longitudinal direction of the envelopes, or when Japanese envelopes with a side seam are conveyed in a direction parallel to a longitudinal direction of the envelopes), the uppermost medium 101 tilts relative to a horizontal plane in the lateral direction (or x-axis direction), and thus abuts only one side of the pickup roller 302. This is referred to as one-sided abutment. Further, as illustrated in FIG. 8, the stacked media 101 tilts and forms a gap G between the fixed guide 304 and the stacked media 101.

Figure 9:
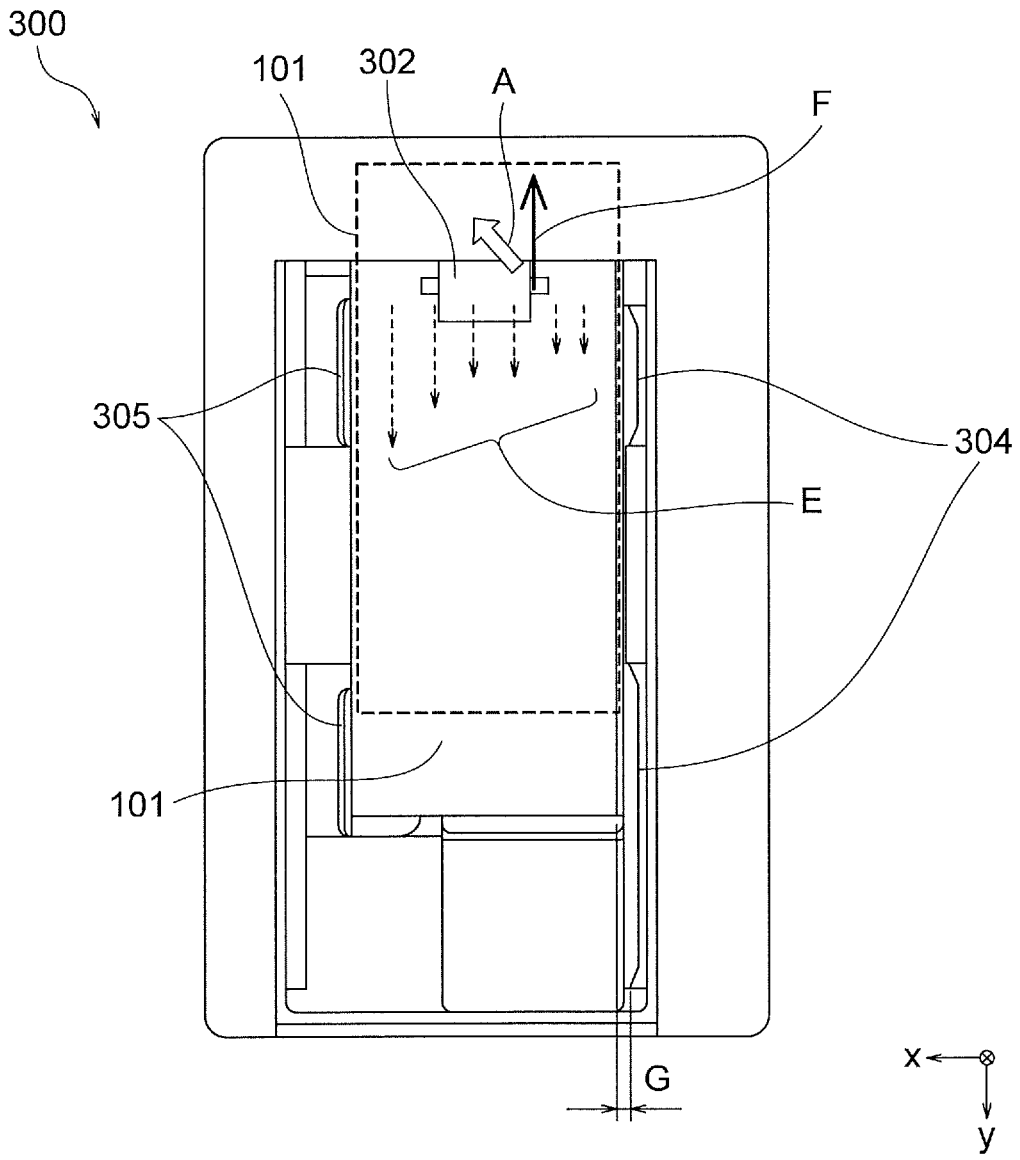
FIG. 9 is a top view schematically illustrating the configuration of the medium conveying apparatus according to the comparative example.

FIG. 9 is a top view schematically illustrating the configuration of the medium conveying apparatus 300 according to the comparative example. As illustrated in FIG. 9, when the pickup roller 302 conveys the uppermost medium 101 while the uppermost medium 101 abuts only one side of the pickup roller 302, the pickup roller 302 applies conveying force F to the uppermost medium 101 at a position off the center of the uppermost medium 101 in the width direction. Thus, the frictional force E in the conveying direction between the picked up medium 101 and the medium 101 therebeneath is non-uniform in the width direction, and the picked up uppermost medium 101 receives a force that urges the uppermost medium 101 to skew in the direction of arrow A in FIG. 9.

Further, as illustrated in FIGS. 8 and 9, since the movable guide 305 for maintaining the attitude of the stacked media 101 is locked at a position where it abuts a lowermost part of the stacked media 101, which is in a horizontal attitude, a gap G is formed between the tilted uppermost medium 101 and the fixed guide 304. Thus, the guides cannot prevent the uppermost medium 101 from skewing.

As above, in the medium conveying apparatus 300 according to the comparative example, the uppermost medium 101 tilts relative to a horizontal plane in the lateral direction, so that the uppermost medium 101 abuts only one side of the pickup roller 302. This causes a force that urges the uppermost medium 101 to skew in the direction of arrow A in FIG. 9. Further, due to the gap G1 between the uppermost medium 101 and the fixed guide 304, the guides cannot prevent the uppermost medium 101 from skewing. Thus, the skew of the medium 101 occurs.

In this specification, the term "parallel" is intended to include substantially parallel, and the term "perpendicular" is intended to include substantially perpendicular.

The present invention is not limited to the embodiments described above; it can be practiced in various other aspects without departing from the invention scope.

What is claimed is:

1. A medium conveying apparatus for conveying media in a conveying direction, comprising:

a medium container on which the media are stacked; and a medium separator that abuts an uppermost medium of the media stacked on the medium container and separates the uppermost medium from the media stacked on the medium container, wherein the medium container includes:

a medium support that abuts a lowermost medium of the media stacked on the medium container and supports the stacked media;

a tilting mechanism that tilts the medium support relative to a horizontal plane at a tilt angle according to a weight of the media stacked on the medium container, the tilting mechanism tilting the medium support in a lateral direction that is parallel to the horizontal plane and perpendicular to the conveying direction;

a first limiter; and a second limiter, wherein the tilting mechanism includes a first elastic member and a second elastic member that each apply upward elastic force to the medium support, wherein the first elastic member abuts a lower side of a first side of the medium support in the lateral direction, wherein the second elastic member abuts a lower side of a second side of the medium support opposite to the first side in the lateral direction, wherein the first limiter abuts an upper side of the first side of the medium support to limit upward movement of the first side, the first limiter abutting the first side outside the stacked media in the lateral direction, wherein the second limiter abuts an upper side of the second side of the medium support to limit upward movement of the second side, the second limiter abutting the second side outside the stacked media in the lateral direction, and wherein the medium support tilts due to difference in compression rate between the first elastic member and the second elastic member caused by difference in weight of the media stacked on the medium container in the lateral direction.

2. The medium conveying apparatus of claim 1, wherein the tilting mechanism tilts the medium support in the conveying direction.

* * * * *